US011826601B1

(12) United States Patent
Berme

(10) Patent No.: US 11,826,601 B1
(45) Date of Patent: Nov. 28, 2023

(54) CABLE ACTUATION SYSTEM

(71) Applicant: Bertec Corporation, Columbus, OH (US)

(72) Inventor: Necip Berme, Worthington, OH (US)

(73) Assignee: Bertec Corporation, Columbus, OH (US)

( * ) Notice: Subject to any disclaimer, the term of this patent is extended or adjusted under 35 U.S.C. 154(b) by 0 days.

(21) Appl. No.: 17/156,617

(22) Filed: Jan. 24, 2021

Related U.S. Application Data

(60) Provisional application No. 62/965,844, filed on Jan. 25, 2020.

(51) Int. Cl.

| | |
|---|---|
| ***A63B 21/00*** | (2006.01) |
| ***A63B 21/005*** | (2006.01) |
| ***A63B 24/00*** | (2006.01) |
| ***A63B 22/02*** | (2006.01) |
| ***A63B 71/04*** | (2006.01) |

(52) U.S. Cl.
CPC ..... *A63B 21/151* (2013.01); *A63B 21/0058* (2013.01); *A63B 21/00181* (2013.01); *A63B 21/4001* (2015.10); *A63B 22/02* (2013.01); *A63B 24/0062* (2013.01); *A63B 71/04* (2013.01); *A63B 2024/0093* (2013.01); *A63B 2220/51* (2013.01)

(58) Field of Classification Search
None
See application file for complete search history.

(56) References Cited

U.S. PATENT DOCUMENTS

| | | | | |
|---|---|---|---|---|
| 6,038,488 | A | 3/2000 | Barnes et al. | |
| 6,113,237 | A | 9/2000 | Ober et al. | |
| 6,123,649 | A * | 9/2000 | Lee | A63B 21/4013 482/54 |
| 6,152,564 | A | 11/2000 | Ober et al. | |
| 6,295,878 | B1 | 10/2001 | Berme | |
| 6,354,155 | B1 | 3/2002 | Berme | |
| 6,389,883 | B1 | 5/2002 | Berme et al. | |
| 6,936,016 | B2 | 8/2005 | Berme et al. | |
| 7,066,865 | B2 * | 6/2006 | Radow | A63B 24/00 482/4 |
| 8,181,541 | B2 | 5/2012 | Berme | |

(Continued)

FOREIGN PATENT DOCUMENTS

| | | | |
|---|---|---|---|
| CN | 204469114 U * | 7/2015 | |
| KR | 100981703 B1 * | 9/2010 | |
| WO | WO-2008152627 A2 * | 12/2008 | A63B 21/00069 |

*Primary Examiner* — Shila Jalalzadeh Abyaneh
(74) *Attorney, Agent, or Firm* — The Law Office of Patrick F. O'Reilly III, LLC

(57) ABSTRACT

A cable actuation system configured to apply a force to a person is disclosed herein. The cable actuation system includes a cable having a first end and a second end, the second end being oppositely disposed relative to the first end, and the first end of the cable configured to be coupled to a person; an actuator operatively coupled to the second end of the cable, the actuator configured to apply a force to the cable; and a control system operatively coupled to the actuator, the control system configured to determine the force being applied to the cable by the actuator, and the control system configured to apply a controlled force to the person by means of the actuator based upon feedback from the force applied to the cable.

19 Claims, 5 Drawing Sheets

(56) References Cited

U.S. PATENT DOCUMENTS 8,315,822 B2 11/2012 Berme et al.
8,315,823 B2 11/2012 Berme et al.
8,366,589 B2 * 2/2013 Tyree ..... A63B 21/0552 482/14
D689,388 S 9/2013 Berme
D689,389 S 9/2013 Berme
8,543,540 B1 9/2013 Wilson et al.
8,544,347 B1 10/2013 Berme
8,643,669 B1 2/2014 Wilson et al.
8,700,569 B1 4/2014 Wilson et al.
8,704,855 B1 4/2014 Berme et al.
8,764,532 B1 7/2014 Berme
8,847,989 B1 9/2014 Berme et al.
D715,669 S 10/2014 Berme
8,902,249 B1 12/2014 Wilson et al.
8,915,149 B1 12/2014 Berme
9,032,817 B2 5/2015 Berme et al.
9,043,278 B1 5/2015 Wilson et al.
9,066,667 B1 6/2015 Berme et al.
9,081,436 B1 7/2015 Berme et al.
9,168,420 B1 10/2015 Berme et al.
9,173,596 B1 11/2015 Berme et al.
9,200,897 B1 12/2015 Wilson et al.
9,254,417 B2 * 2/2016 Lawrence ..... A63B 24/00
9,277,857 B1 3/2016 Berme et al.
D755,067 S 5/2016 Berme et al.
9,404,823 B1 8/2016 Berme et al.
9,414,784 B1 8/2016 Berme et al.
9,468,370 B1 10/2016 Shearer
9,517,008 B1 12/2016 Berme et al.
9,526,443 B1 12/2016 Berme et al.
9,526,451 B1 12/2016 Berme
9,558,399 B1 1/2017 Jeka et al.
9,568,382 B1 2/2017 Berme et al.
9,622,686 B1 4/2017 Berme et al.
9,763,604 B1 9/2017 Berme et al.
9,770,203 B1 9/2017 Berme et al.
9,778,119 B2 10/2017 Berme et al.
9,814,430 B1 11/2017 Berme et al.
9,829,311 B1 11/2017 Wilson et al.
9,854,997 B1 1/2018 Berme et al.
9,873,012 B2 * 1/2018 Huppée ..... A63B 23/0417
9,916,011 B1 3/2018 Berme et al.
9,927,312 B1 3/2018 Berme et al.
9,987,188 B1 * 6/2018 Diao ..... A63B 24/0087
10,010,248 B1 7/2018 Shearer
10,010,286 B1 7/2018 Berme et al.
10,085,676 B1 10/2018 Berme et al.
10,117,602 B1 11/2018 Berme et al.
10,126,186 B2 11/2018 Berme et al.
10,216,262 B1 2/2019 Berme et al.
10,231,662 B1 3/2019 Berme et al.
10,264,964 B1 4/2019 Berme et al.
10,331,324 B1 6/2019 Wilson et al.
10,342,473 B1 7/2019 Berme et al.
10,390,736 B1 8/2019 Berme et al.
10,413,230 B1 9/2019 Berme et al.
10,463,250 B1 11/2019 Berme et al.
10,527,508 B2 1/2020 Berme et al.
10,555,688 B1 2/2020 Berme et al.
10,610,719 B2 * 4/2020 Wehrell ..... A63B 21/154
10,646,153 B1 5/2020 Berme et al.
10,722,114 B1 7/2020 Berme et al.
10,736,545 B1 8/2020 Berme et al.
10,765,936 B2 9/2020 Berme et al.
10,803,990 B1 10/2020 Wilson et al.
10,828,524 B1 * 11/2020 Birgen ..... A63B 21/154
10,853,970 B1 12/2020 Akbas et al.
10,856,796 B1 12/2020 Berme et al.
10,860,843 B1 12/2020 Berme et al.
10,945,599 B1 3/2021 Berme et al.
10,966,606 B1 4/2021 Berme
11,033,453 B1 6/2021 Berme et al.
11,052,288 B1 7/2021 Berme et al.
11,054,325 B2 7/2021 Berme et al.
11,074,711 B1 7/2021 Akbas et al.
11,097,154 B1 8/2021 Berme et al.
11,158,422 B1 10/2021 Wilson et al.
11,182,924 B1 11/2021 Akbas et al.
11,262,231 B1 3/2022 Berme et al.
11,262,258 B2 3/2022 Berme et al.
11,301,045 B1 4/2022 Berme et al.
11,311,209 B1 4/2022 Berme et al.
11,321,868 B1 5/2022 Akbas et al.
11,337,606 B1 5/2022 Berme et al.
11,348,279 B1 5/2022 Akbas et al.
2002/0025891 A1 * 2/2002 Colosky, Jr. ..... A63B 21/0455 482/127
2003/0216656 A1 11/2003 Berme et al.
2008/0228110 A1 9/2008 Berme
2011/0277562 A1 11/2011 Berme
2012/0266648 A1 10/2012 Berme et al.
2012/0271565 A1 10/2012 Berme et al.
2015/0096387 A1 4/2015 Berme et al.
2015/0367171 A1 * 12/2015 Truong ..... A63B 22/02 482/4
2016/0043200 A1 * 2/2016 Mihara ..... H01L 27/11565 438/287
2016/0245711 A1 8/2016 Berme et al.
2016/0325131 A1 * 11/2016 Wehrell ..... A63B 21/4009
2016/0334288 A1 11/2016 Berme et al.
2016/0338896 A1 * 11/2016 Gruben ..... A61H 1/0262
2017/0027803 A1 * 2/2017 Agrawal ..... A61B 5/1122
2017/0312582 A1 * 11/2017 Root, Jr. ..... A63B 21/4009
2018/0024015 A1 1/2018 Berme et al.
2018/0214729 A1 * 8/2018 Rubin ..... A63B 21/0058
2018/0264306 A1 * 9/2018 Agrawal ..... A63B 24/0087
2018/0361189 A1 * 12/2018 Gupta ..... A63B 21/0054
2019/0046830 A1 * 2/2019 Chiavegato ..... A63B 24/0062
2019/0078951 A1 3/2019 Berme et al.
2019/0344123 A1 * 11/2019 Rubin ..... A63B 21/4033
2020/0086163 A1 * 3/2020 Karys ..... A63B 21/0442
2020/0139229 A1 5/2020 Berme et al.
2020/0222266 A1 * 7/2020 Gordon ..... A61H 3/008
2020/0408625 A1 12/2020 Berme et al.
2021/0113418 A1 * 4/2021 Matsumoto ..... A61H 1/00
2021/0333163 A1 10/2021 Berme et al.

* cited by examiner

CABLE ACTUATION SYSTEM

CROSS-REFERENCE TO RELATED APPLICATIONS

This patent application claims priority to, and incorporates by reference in its entirety, U.S. Provisional Patent Application No. 62/965,844, entitled "Cable Actuation System", filed on Jan. 25, 2020.

STATEMENT REGARDING FEDERALLY SPONSORED RESEARCH OR DEVELOPMENT

Not Applicable.

NAMES OF THE PARTIES TO A JOINT RESEARCH AGREEMENT

Not Applicable.

INCORPORATION BY REFERENCE OF MATERIAL SUBMITTED ON A COMPACT DISK

Not Applicable.

BACKGROUND OF THE INVENTION

1. Field of the Invention

The invention generally relates to a cable actuation system. More particularly, the invention relates to a cable actuation system that is capable of perturbing or enhancing a postural stability of a person undergoing balance and/or gait testing or training.

2. Background and Description of Related Art

In order to study human motion, subjects are often tested in gait labs which are provided with special equipment disposed therein for measuring body movements, body mechanics, and/or the activity of the muscles (e.g., gait labs with force plates, etc.). The gait analysis performed in the gait lab is typically used to assess, plan, and/or treat subjects with medical conditions affecting their ability to walk. Also, the gait analysis is often used in sports biomechanics to improve athletic performance, and to help identify and/or treat injuries that deleteriously affect athletic performance.

However, the artificial nature of a typical environment for testing and/or training the balance and/or gait of a subject (e.g., a typical gait lab or clinician's office) makes it difficult to simulate the real-life conditions that are encountered by the subject. Also, these artificial environments for balance and gait testing and/or training are unable to effectively simulate the uncertain nature of the stimuli encountered by subjects in real-life scenarios. As such, these balance gait testing and/or training environments are limited in their overall ability to effectively test and/or train subjects for the scenarios that are actually experienced by subjects in the their everyday lives.

Therefore, what is needed is a cable actuation system that is capable of perturbing a postural stability of a person so as to simulate real-life conditions. Moreover, a cable actuation system is needed that is capable of enhancing a postural stability of a person undergoing balance and/or gait testing or training. Furthermore, what is needed is a cable actuation system that obviates the need for perturbations to be applied by a motion base, which is far more costly than the cable actuation system.

BRIEF SUMMARY OF EMBODIMENTS OF THE INVENTION

Accordingly, the present invention is directed to a cable actuation system that substantially obviates one or more problems resulting from the limitations and deficiencies of the related art.

In accordance with one or more embodiments of the present invention, there is provided a cable actuation system configured to apply a force to a person. The cable actuation system comprises a cable having a first end and a second end, the second end being oppositely disposed relative to the first end, and the first end of the cable configured to be coupled to a person; an actuator operatively coupled to the second end of the cable, the actuator configured to apply a force to the cable; and a control system operatively coupled to the actuator, the control system configured to determine the force being applied to the cable by the actuator, and the control system configured to apply a controlled force to the person by means of the actuator based upon feedback from the force applied to the cable.

In a further embodiment of the present invention, the actuator comprises an electric motor, and the control system is operatively coupled to the electric motor.

In yet a further embodiment, the torque generated by the electric motor is proportional to the force applied to the cable by the electric motor, and the control system is configured to determine the force being applied to the cable based upon the torque generated by the electric motor.

In still a further embodiment, the cable actuation system further comprises a load cell operatively coupled to the cable, the load cell configured to measure the force applied to the cable by the actuator, and the control system being configured to determine the force being applied to the cable based upon output data from the load cell.

In yet a further embodiment, the load cell is disposed between the first end and the second end of the cable.

In still a further embodiment, the cable actuation system further comprises an enclosure for housing the actuator, the enclosure configured to be mounted on a floor, wall, or ceiling of a room.

In yet a further embodiment, the enclosure resembles a post or pedestal, and the enclosure is mounted on the floor of the room.

In still a further embodiment, the cable actuation system further comprises a plurality of cables operatively coupled to respective actuators for applying a plurality of controlled forces to different body portions of the person, each of the actuators being operatively coupled to the control system.

In yet a further embodiment, the control system comprises a computer-based control system with a microprocessor.

In still a further embodiment, the first end of the cable is coupled to the person via a harness or belt worn by the person.

In yet a further embodiment, the controlled force applied to the person by the actuator perturbs a postural stability of the person.

In still a further embodiment, the controlled force applied to the person by the actuator enhances a postural stability of the person.

In yet a further embodiment, the cable actuation system further comprises a treadmill configured to accommodate the person running or walking thereon.

In still a further embodiment, the cable actuation system further comprises a force measurement assembly configured to receive the person. The force measurement assembly includes a top surface for receiving at least one portion of the body of the person; and at least one force transducer, the at least one force transducer configured to sense one or more measured quantities and output one or more signals that are representative of forces and/or moments being applied to the top surface of the force measurement assembly by the person. The force measurement assembly is operatively coupled to the control system, the control system configured to receive the one or more signals that are representative of the forces and/or moments being applied to the top surface of the force measurement assembly by the person, and to convert the one or more signals into output forces and/or moments.

In yet a further embodiment, the force measurement assembly is in the form of a dynamic or static force plate.

In still a further embodiment, the force measurement assembly is in the form of an instrumented treadmill.

It is to be understood that the foregoing general description and the following detailed description of the present invention are merely exemplary and explanatory in nature. As such, the foregoing general description and the following detailed description of the invention should not be construed to limit the scope of the appended claims in any sense.

BRIEF DESCRIPTION OF THE SEVERAL VIEWS OF THE DRAWINGS

The invention will now be described, by way of example, with reference to the accompanying drawings, in which.

Throughout the figures, the same elements are always denoted using the same reference characters so that, as a general rule, they will only be described once.

DETAILED DESCRIPTION OF EMBODIMENTS OF THE INVENTION

Figure 1:
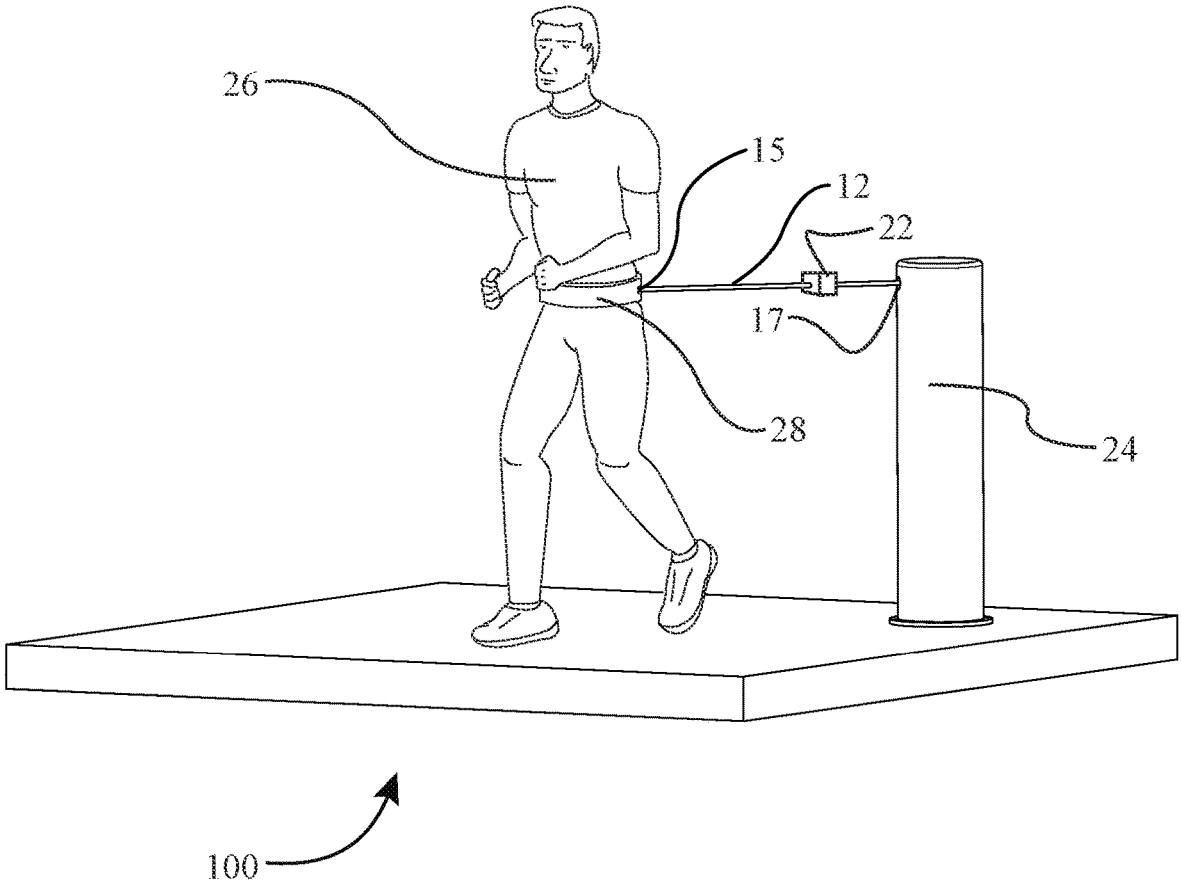
FIG. 1 is a perspective view of a cable actuation system, according to an illustrative embodiment of the invention.
Figure 2:
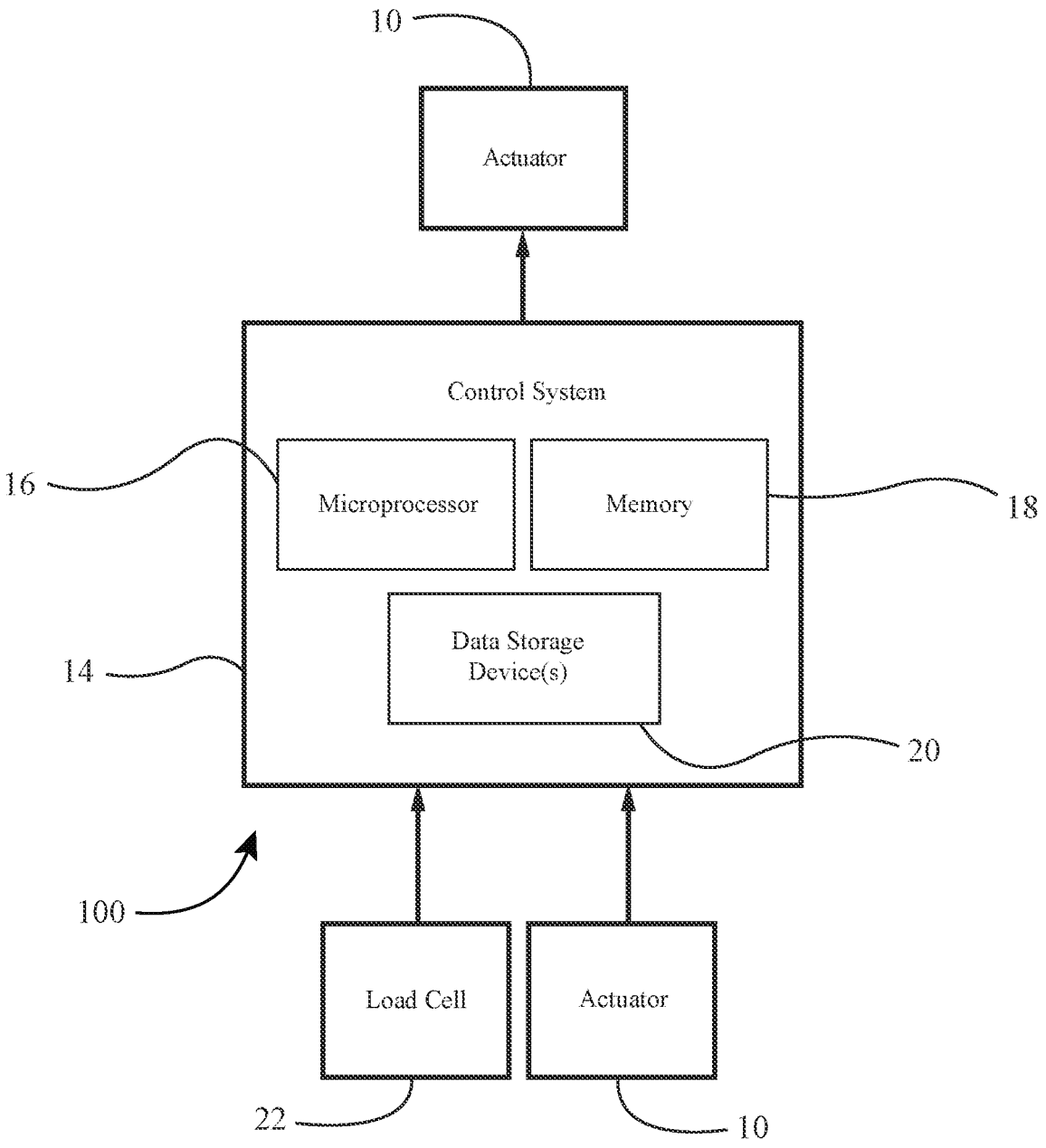
FIG. 2 is a block diagram of constituent components of cable actuation system of FIG. 1, according to the illustrative embodiment of the invention.

An illustrative embodiment of a cable actuation system configured to apply a force to a person is seen generally at 100 in FIGS. 1 and 2. In the illustrative embodiment of FIGS. 1 and 2, the cable actuation system 100 generally comprises a cable 12 having a first end 15 and a second end 17, the second end 17 being oppositely disposed relative to the first end 15, and the first end 15 of the cable 12 configured to be coupled to a person 26 (see FIG. 1); an actuator 10 operatively coupled to the second end 17 of the cable 12, the actuator 10 configured to apply a force to the cable 12; and a control system 14 operatively coupled to the actuator 10, the control system 14 configured to determine the force being applied to the cable 12 by the actuator 10, and the control system 14 configured to apply a controlled force to the person 26 by means of the actuator 10 based upon feedback from the force applied to the cable 12.

Now, turning to FIG. 2, it can be seen that the illustrated control system 14 of the cable actuation system 100 includes a microprocessor 16 for processing data, memory 18 (e.g., random access memory or RAM) for storing data during the processing thereof, and data storage device(s) 20, such as one or more hard drives, compact disk drives, floppy disk drives, flash drives, or any combination thereof. As shown in FIG. 2, the actuator 10 and the load cell 22 are operatively coupled to the control system 14 such that data is capable of being transferred between these devices 10, 14, and 22. In the illustrative embodiment, the control system 14 comprises a computer-based control system with the microprocessor 16.

In the illustrative embodiment, the actuator 10 comprises an electric motor, and the control system 14 is operatively coupled to the electric motor (see FIG. 2). In a first variation of the illustrative embodiment, the torque generated by the electric motor is proportional to the force applied to the cable 12 by the electric motor, and the control system 14 is configured to determine the force being applied to the cable 12 based upon the torque generated by the electric motor.

In a second variation of the illustrative embodiment, the cable actuation system 100 further comprises a load cell 22 operatively coupled to the cable 12, and the load cell 22 is configured to measure the force applied to the cable 12 by the actuator 10. As shown in FIG. 2, the control system 14 is operatively coupled to the load cell 22, and the control system 14 is configured to determine the force being applied to the cable 12 based upon output data from the load cell 22. In the illustrative embodiment, the load cell 22 is disposed between the first end 15 and the second end 17 of the cable 12 (see e.g., FIG. 1)

Referring again to FIG. 1, in the illustrative embodiment, the cable actuation system 100 further comprises an enclosure 24 for housing the actuator (e.g., the electric motor). In the illustrative embodiment of FIG. 1, the enclosure 24 is mounted on the floor of a room. In other embodiments, the enclosure 24 alternatively may be mounted to the wall or ceiling of a room. As shown in FIG. 1, in the illustrative embodiment, the enclosure 24 resembles a post or pedestal (e.g., a bollard post).

As shown in the illustrative embodiment of FIG. 1, the first end 15 of the cable 12 is coupled to the person 26 via a belt 28 worn by the person 26. In other embodiments, the first end 15 of the cable 12 may be coupled to the person 26 via a harness worn by the person 26.

In the illustrative embodiment, the controlled force applied to the person 26 by the actuator 10 may perturb a postural stability of the person 26. For example, the cable 12 may pull the person 26 to the left side to perturb the balance of the person 26. Also, in the illustrative embodiment, the controlled force applied to the person 26 by the actuator 10 may alternatively enhance a postural stability of the person 26. For example, the cable 12 may pull the person 26 to the right side to counteract the person 26 falling to his or her left side.

In one or more embodiments, the cable actuation system 100 further comprises a treadmill configured to accommodate the person 26 running or walking thereon. For example, the treadmill may comprise an exercise treadmill or an instrumented treadmill, such as the instrumented treadmill 10 described in U.S. Pat. No. 10,390,736, the entire disclosure of which is incorporated herein by reference.

Figure 5:
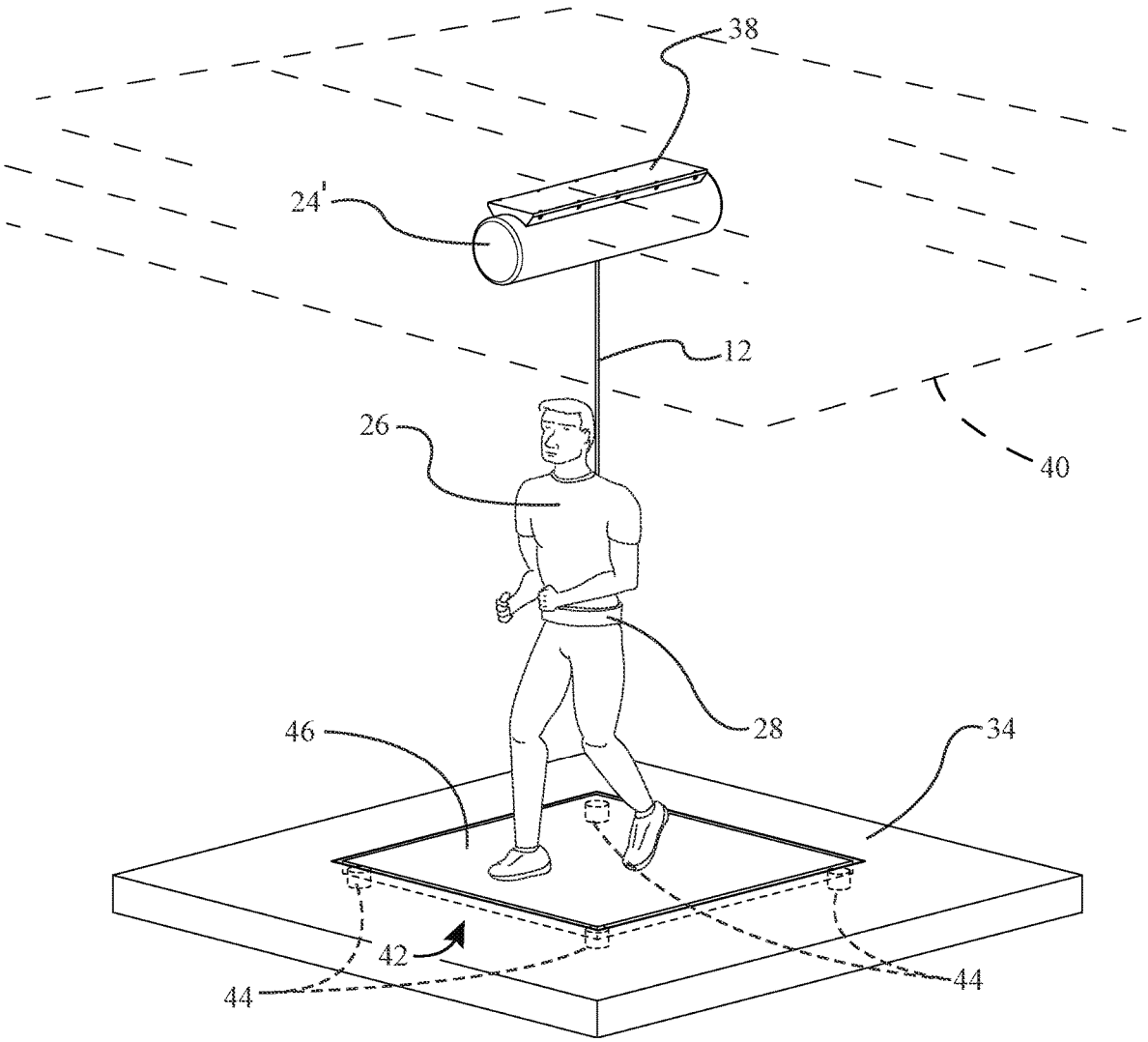
FIG. 5 is a perspective view of a third exemplary perturbation arrangement using the cable actuation system of FIG. 1.

In one or more embodiments, the cable actuation system 100 further comprises a force measurement assembly 42 configured to receive the person 26 (see e.g., FIG. 5). The force measurement assembly 42 includes a top surface 46 for receiving at least one portion of the body of the person 26; and at least one force transducer 44, the at least one force transducer 44 configured to sense one or more measured quantities and output one or more signals that are representative of forces and/or moments being applied to the top surface 46 of the force measurement assembly 42 by the person 26. In these one or more embodiments, the force measurement assembly 42 is operatively coupled to the control system 14. The control system 14 is configured to receive the one or more signals that are representative of the forces and/or moments being applied to the top surface 46 of the force measurement assembly 42 by the person 26, and the control system 14 is configured to convert the one or more signals into output forces and/or moments. In some embodiments, the force measurement assembly 42 is in the form of a dynamic or static force plate, such as the dynamic force plate 102 or the static force plate 102' described in U.S. Pat. No. 10,413,230, the entire disclosure of which is incorporated herein by reference. In other embodiments, the force measurement assembly is in the form of an instrumented treadmill, such as the instrumented treadmill 10 described in U.S. Pat. No. 10,390,736, the entire disclosure of which is incorporated herein by reference.

In further embodiments, the cable actuation system may comprise a plurality of cables 12 operatively coupled to respective actuators 10 for applying a plurality of controlled forces to different body portions of the person 26. Each of these actuators 10 may be operatively coupled to the control system 14. For example, the room may be provided with a plurality of post enclosures 24 mounted to the floor of the room. Each of these post enclosures 24 may contain a respective actuator 10 and a cable 12 attached to a different portion of the body of the person 26. For example, a first cable 12 may be attached to the left side of the person 26, a second cable 12 may be attached to the right side of the person 26, a third cable 12 may be attached to the anterior side of the person 26, and a fourth cable 12 may be attached to the posterior side of the person 26. As such, forces may be applied in different directions to the person 26.

Figure 3:
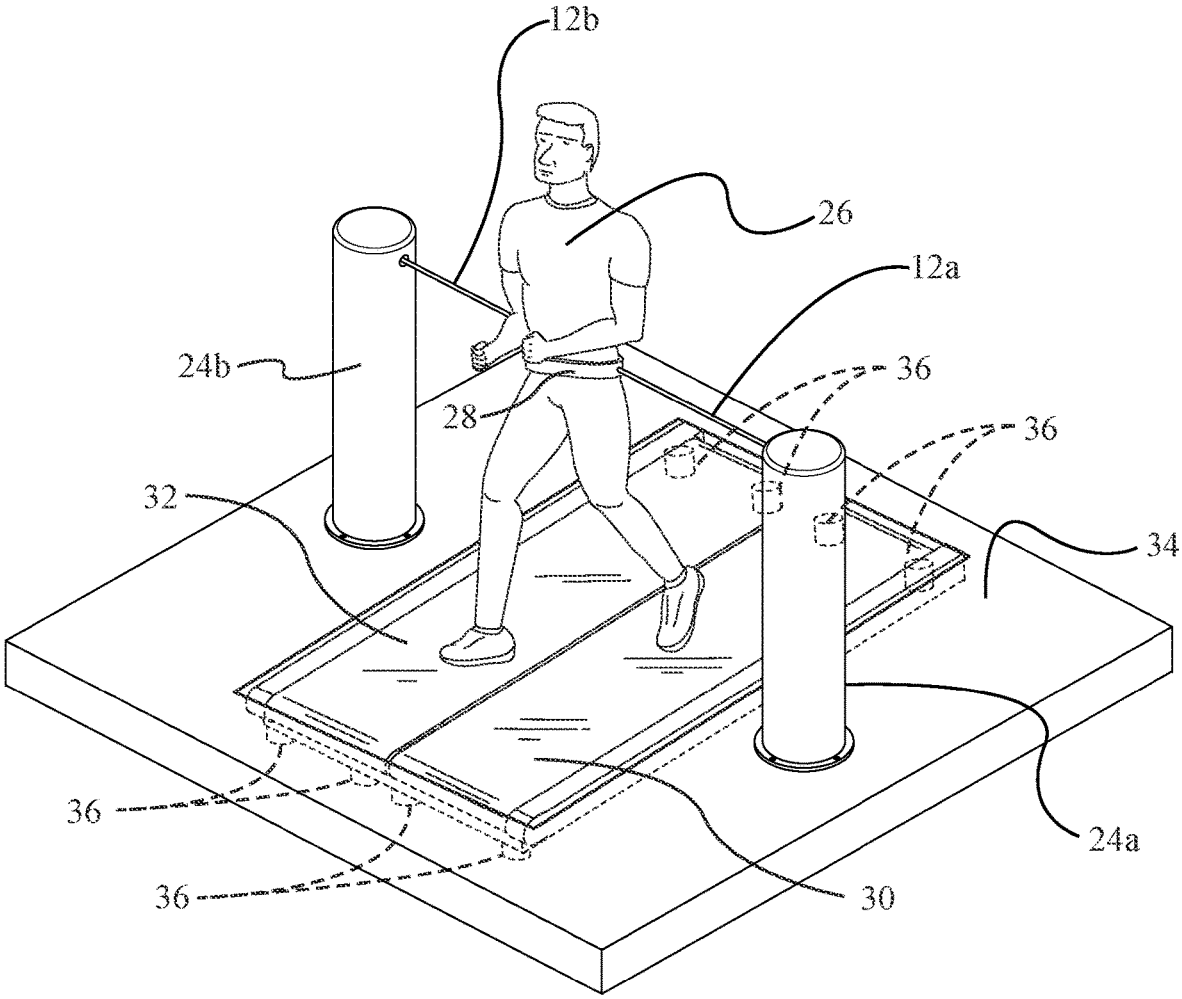
FIG. 3 is a perspective view of a first exemplary perturbation arrangement using the cable actuation system of FIG. 1.

A first exemplary perturbation arrangement using the cable actuation system of FIG. 1 is depicted in FIG. 3. As shown in FIG. 3, two (2) post enclosures 24*a*, 24*b* are mounted to the floor 34 of a room so that lateral forces may be applied to opposite sides of the person 26. In the arrangement of FIG. 3, the post enclosures 24*a*, 24*b* are generally aligned with one another such that a first cable 12*a* pulling on the left side of the person 26 is generally aligned with a second cable 12*b* pulling on the right side of the person 26. In the arrangement of FIG. 3, the first cable 12*a* applies a first lateral force to the left side of the person 26 that is generally opposite to a second lateral force applied to the right side of the person 26 by the second cable 12*b*. In the arrangement of FIG. 3, the person 26 is disposed on an instrumented treadmill with left and right treadmill belts 30, 32. Each of the treadmill belts 30, 32 is provided with force transducer pylons 36 thereunder for measuring the forces and/or moments exerted on the treadmill belts 30, 32 by the person 26.

Figure 4:
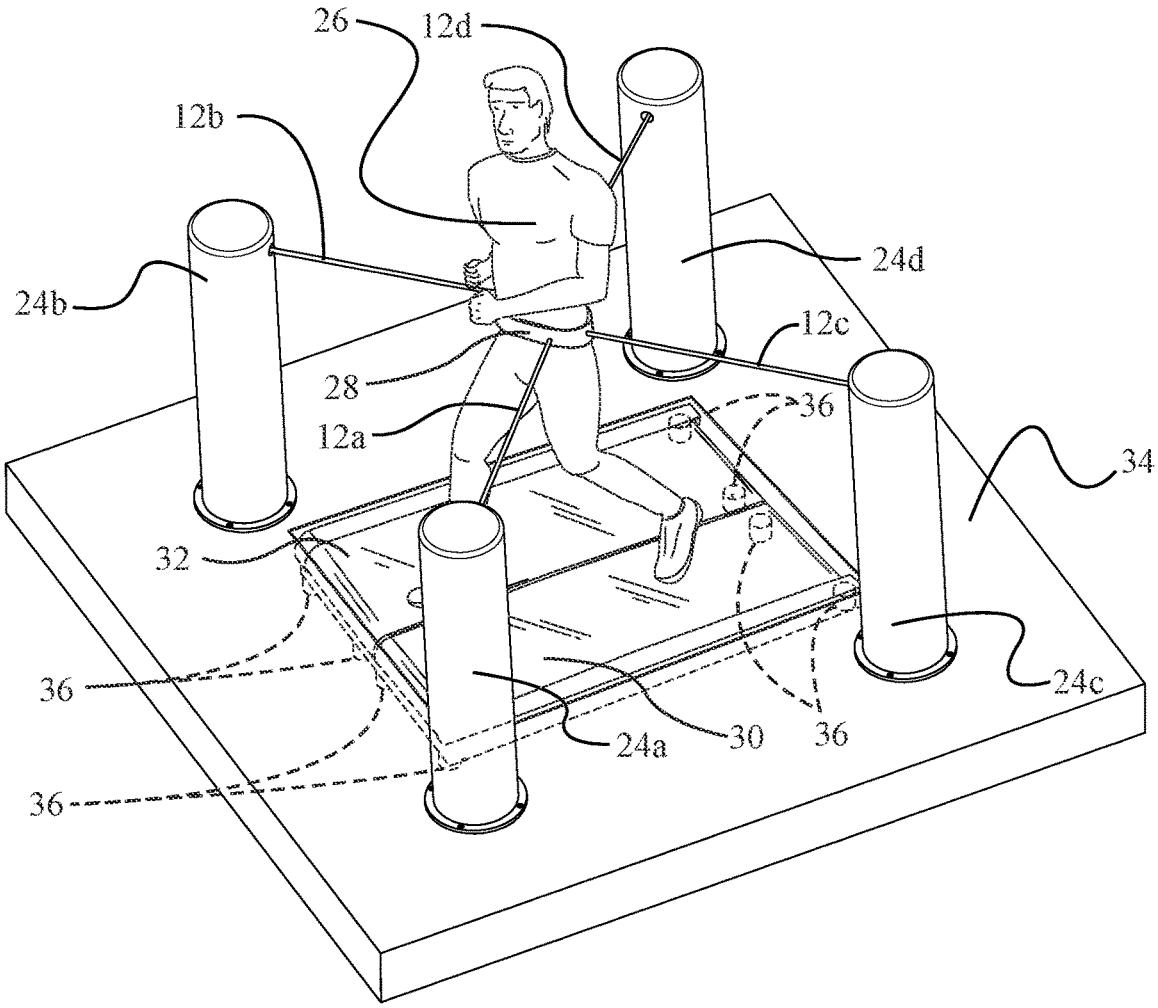
FIG. 4 is a perspective view of a second exemplary perturbation arrangement using the cable actuation system of FIG. 1.

A second exemplary perturbation arrangement using the cable actuation system of FIG. 1 is depicted in FIG. 4. As shown in FIG. 4, four (4) post enclosures 24*a*, 24*b*, 24*c*, 24*d* are mounted to the floor 34 of a room so that combination anterior/posterior and lateral forces may be applied to the person 26. In the arrangement of FIG. 4, the first pair of post enclosures 24*a*, 24*b* are disposed in front of the person 26, and apply diagonal forces to the person 26. More specifically, the first post enclosure 24*a* applies a combination left lateral force/anterior force to the person 26 by means of cable 12*a*. The second post enclosure 24*b* applies a combination right lateral force/anterior force to the person 26 by means of cable 12*b*. The second pair of post enclosures 24*c*, 24*d* are disposed behind the person 26, and apply diagonal forces to the person 26. More specifically, the third post enclosure 24*c* applies a combination left lateral force/posterior force to the person 26 by means of cable 12*c*. The fourth post enclosure 24*d* applies a combination right lateral force/posterior force to the person 26 by means of cable 12*d*. Similar to the arrangement of FIG. 3, in the arrangement of FIG. 4, the person 26 is disposed on an instrumented treadmill with left and right treadmill belts 30, 32. Each of the treadmill belts 30, 32 is provided with force transducer pylons 36 thereunder for measuring the forces and/or moments exerted on the treadmill belts 30, 32 by the person 26.

A third exemplary perturbation arrangement using the cable actuation system of FIG. 1 is depicted in FIG. 5. As shown in FIG. 5, a single post enclosure 24' is mounted to the ceiling 40 of a room so that a posterior force may be applied to the person 26 via cable 12. As shown in FIG. 5, the post enclosure 24' is supported from the ceiling 40 of the room by mount 38. In the arrangement of FIG. 5, the person 26 is disposed on a force plate 42 with force transducer pylons 44 thereunder for measuring the forces and/or moments exerted on the top surface 46 of the force plate 42 by the person 26.

In one or more illustrative embodiments, the controlled force(s) applied to the person 26 in the arrangements of FIGS. 3-5 by the actuator(s) 10 may alternatively enhance a postural stability of the person 26. For example, the cables 12, 12*a*, 12*b*, 12*c*, 12*d* may pull the person 26 to a particular side to counteract the person 26 falling to the particular one of his or her sides.

Advantageously, the cable actuation system 100 described above is in the form of a standalone cable system that enables additional standalone units to be easily added to the system for applying perturbations to a plurality of different sides of the person. The actuators 10 of each of the standalone units may each be wirelessly coupled to the control system 14 so that hard wiring is not required. As such, the standalone cable system described herein obviates the need for pulleys, trolleys, tracks, or movable carriages that complicate the system. In the illustrative embodiment described above, the cable actuation system 100 does not include any pulleys, trolleys, tracks, or movable carriages.

It is readily apparent from the above detailed description that the cable actuation system 100 described above substantially benefits the field of human balance assessment and human gait analysis. First, the cable actuation system 100 is capable of perturbing a postural stability of a person 26 so as to simulate real-life conditions. Secondly, the cable actuation system 100 is capable of enhancing a postural stability of a person 26 undergoing balance and/or gait testing or training. Finally, the cable actuation system 100 obviates the need for perturbations to be applied by a motion base, which is far more costly than the cable actuation system 100.

Any of the features or attributes of the above described embodiments and variations can be used in combination with any of the other features and attributes of the above described embodiments and variations as desired. Also, the compound conjunction "and/or" is used throughout this disclosure to mean one or the other, or both.

Although the invention has been shown and described with respect to a certain embodiment or embodiments, it is apparent that this invention can be embodied in many different forms and that many other modifications and variations are possible without departing from the spirit and scope of this invention.

Moreover, while exemplary embodiments have been described herein, one of ordinary skill in the art will readily appreciate that the exemplary embodiments set forth above are merely illustrative in nature and should not be construed as to limit the claims in any manner. Rather, the scope of the invention is defined only by the appended claims and their equivalents, and not, by the preceding description.

The invention claimed is:

1. A cable actuation system configured to apply a force to a person, the cable actuation system comprising:

at least one cable having a first end and a second end, the second end being oppositely disposed relative to the first end, and the first end of the at least one cable configured to be coupled to a person;

at least one actuator operatively coupled to the second end of the at least one cable, the at least one actuator configured to apply a force to the at least one cable;

a control system operatively coupled to the at least one actuator, the control system configured to determine the force being applied to the at least one cable by the at least one actuator, and the control system configured to apply a controlled force to the person by means of the at least one actuator based upon feedback from the force applied to the at least one cable; and an enclosure configured to house an actuator of the at least one actuator, the enclosure including a bottom portion mounted to a floor surface of a room, a top wall, and a side wall extending from the bottom portion to the top wall, and the top wall of the enclosure configured to be disposed at an elevation that is at a waist height of the person disposed in a standing position, the enclosure defining an enclosure footprint on the floor surface and the side wall of the enclosure having a wall height, and the wall height of the enclosure being greater than a largest dimension of the enclosure footprint.

2. The cable actuation system according to claim 1, further comprising a force measurement assembly configured to receive the person, the force measurement assembly including:

a top surface for receiving at least one portion of a body of the person; and at least one force transducer, the at least one force transducer configured to sense one or more measured quantities and output one or more signals that are representative of forces and/or moments being applied to the top surface of the force measurement assembly by the person;

wherein the force measurement assembly is operatively coupled to the control system, the control system configured to receive the one or more signals that are representative of the forces and/or moments being applied to the top surface of the force measurement assembly by the person, and to convert the one or more signals into output forces and/or moments.

3. The cable actuation system according to claim 2, wherein the force measurement assembly is in the form of a dynamic or static force plate.

4. The cable actuation system according to claim 2, wherein the force measurement assembly is in the form of an instrumented treadmill.

5. The cable actuation system according to claim 2, wherein the force measurement assembly defines a force measurement assembly footprint, and the enclosure is disposed outside the force measurement assembly footprint.

6. The cable actuation system according to claim 1, wherein the at least one actuator comprises an electric motor, and wherein the control system is operatively coupled to the electric motor.

7. The cable actuation system according to claim 6, wherein a torque generated by the electric motor is proportional to the force applied to the at least one cable by the electric motor, and the control system is configured to determine the force being applied to the at least one cable based upon the torque generated by the electric motor.

8. The cable actuation system according to claim 1, further comprising a load cell operatively coupled to the at least one cable, the load cell configured to measure the force applied to the at least one cable by the at least one actuator, and the control system being configured to determine the force being applied to the at least one cable based upon output data from the load cell.

9. The cable actuation system according to claim 8, wherein the load cell is disposed between the first end and the second end of the at least one cable.

10. The cable actuation system according to claim 1, wherein the enclosure resembles a post or pedestal, and the at least one cable extends generally horizontal from an aperture in the side wall of the enclosure to a harness or belt worn by the person.

11. The cable actuation system according to claim 1, wherein the at least one cable comprises a plurality of cables and the at least one actuator comprises a plurality of actuators, wherein each cable of the plurality of cables is operatively coupled to a corresponding actuator of the plurality of actuators for applying a plurality of controlled forces to different body portions of the person, each of the actuators being operatively coupled to the control system.

12. The cable actuation system according to claim 1, wherein the control system comprises a computer-based control system with a microprocessor.

13. The cable actuation system according to claim 1, wherein the first end of the at least one cable is coupled to the person via a harness or belt worn by the person.

14. The cable actuation system according to claim 1, wherein the controlled force applied to the person by the at least one actuator perturbs a postural stability of the person.

15. The cable actuation system according to claim 1, wherein the controlled force applied to the person by the at least one actuator enhances a postural stability of the person.

16. The cable actuation system according to claim 1, further comprising a treadmill configured to accommodate the person running or walking thereon.

17. A cable actuation system configured to apply a force to a person, the cable actuation system comprising:

a first cable having a first end and a second end, the second end being oppositely disposed relative to the first end, and the first end of the first cable configured to be coupled to a first side of a person;

a second cable having a first end and a second end, the second end being oppositely disposed relative to the first end, and the first end of the second cable configured to be coupled to a second side of a person;

a first actuator operatively coupled to the second end of the first cable, the first actuator configured to apply a first force to the first cable;

a second actuator operatively coupled to the second end of the second cable, the second actuator configured to apply a second force to the second cable;

a first enclosure configured to house the first actuator, the first enclosure being disposed in a first location on the first side of the person, the first enclosure including a bottom portion mounted to a floor surface of a room, a top wall, and a side wall extending from the bottom portion to the top wall, and the top wall of the first enclosure configured to be disposed at an elevation that is at a waist height of the person disposed in a standing position, the first enclosure defining an enclosure footprint on the floor surface and the side wall of the first enclosure having a wall height, and the wall height of the first enclosure being greater than a largest dimension of the enclosure footprint;

a second enclosure configured to house the second actuator, the second enclosure being disposed in a second location on the second side of the person, the second enclosure including a bottom portion, a top wall, and a side wall extending from the bottom portion to the top wall; and a control system operatively coupled to the first actuator and the second actuator, the control system configured to determine the first force being applied to the first cable by the first actuator and the second force being applied to the second cable by the second actuator, the control system configured to apply a first controlled force to the person by means of the first actuator based upon feedback from the first force applied to the first cable, and the control system configured to apply a second controlled force to the person by means of the second actuator based upon feedback from the second force applied to the second cable.

18. The cable actuation system according to claim 17, further comprising a force measurement assembly configured to receive the person, the force measurement assembly including:

a top surface for receiving at least one portion of a body of the person; and at least one force transducer, the at least one force transducer configured to sense one or more measured quantities and output one or more signals that are representative of forces and/or moments being applied to the top surface of the force measurement assembly by the person;

wherein the force measurement assembly is operatively coupled to the control system, the control system configured to receive the one or more signals that are representative of the forces and/or moments being applied to the top surface of the force measurement assembly by the person, and to convert the one or more signals into output forces and/or moments.

19. The cable actuation system according to claim 18, wherein the force measurement assembly defines a force measurement assembly footprint, and the first enclosure and second enclosure are disposed outside the force measurement assembly footprint.

* * * * *